US008642150B2

(12) United States Patent
Connell

(10) Patent No.: US 8,642,150 B2
(45) Date of Patent: Feb. 4, 2014

(54) SHIMS FOR BUILDING CONSTRUCTION

(75) Inventor: Robert Urquhart Connell, Victoria (AU)

(73) Assignee: Illinois Tool Works Inc., Glenview, IL (US)

( * ) Notice: Subject to any disclaimer, the term of this patent is extended or adjusted under 35 U.S.C. 154(b) by 246 days.

(21) Appl. No.: 13/256,891

(22) PCT Filed: Mar. 15, 2010

(86) PCT No.: PCT/US2010/027277

§ 371 (c)(1),
(2), (4) Date: Sep. 15, 2011

(87) PCT Pub. No.: WO2010/107680

PCT Pub. Date: Sep. 23, 2010

(65) Prior Publication Data

US 2012/0009389 A1 Jan. 12, 2012

(30) Foreign Application Priority Data

Mar. 16, 2009 (AU) ..... 2009901128

(51) Int. Cl.
*F16B 1/00* (2006.01)
*B32B 3/26* (2006.01)

(52) U.S. Cl.
USPC ..... 428/43; 428/156; 52/98; 52/126.1

(58) Field of Classification Search
USPC ..... 428/43, 156; 52/98, 126.1, 217
See application file for complete search history.

(56) References Cited

U.S. PATENT DOCUMENTS 4,817,794 A 4/1989 Workman
2009/0044463 A1 2/2009 Moscone et al.

FOREIGN PATENT DOCUMENTS

GB 2078328 A 1/1982

OTHER PUBLICATIONS

ISR for PCT/US2010/027277 dated Dec. 9, 2010.

*Primary Examiner* — Alexander Thomas
(74) *Attorney, Agent, or Firm* — Lowe Hauptman & Ham, LLP

(57) ABSTRACT

A shim set comprising at least two shims of different thickness, the shims of the set being integrally formed as a one-piece plastic moulding, the shims of the set being connected in adjacent relationship by a connection which permits an individual shim to be separated from the set but which is flexible to permit a shim while connected to an adjacent shim to be folded over so that the two shims lie in face-to-face relation and thereby form a shim combination of increased thickness.

6 Claims, 3 Drawing Sheets

SHIMS FOR BUILDING CONSTRUCTION

RELATED APPLICATIONS

The present application is national phase of PCT/US2010/027277 filed Mar. 15, 2010, and claims priority from Australian Application Number 2009901128 filed Mar. 16, 2009.

BACKGROUND OF THE INVENTION

1. Field of the Invention

The present invention relates to shims for use in building construction and more particularly to shims for use in erection of building structures composed of concrete panels.

2. Description of the Prior Art

In the erection of building structures from concrete panels, either precast or tilt-up, it is often required to place shims beneath the lower edge of the panel either to level the panel or provide temporary support. Conventionally, shims for this purpose are fabricated from solid plastic in a range of thicknesses. A typical range may be supplied in thicknesses of 1, 2, 3, 5, 10, 15 and 20 mm. The shims generally have the same surface area (the most common size used is 100×150 mm) and 2 or more shims may be stacked to provide packing of required thickness. In practice, the shim thicknesses most commonly used are the 1, 2, and 3 mm thickness as when used singly or in combination with one or more other shims in that range, a large range of different, commonly required, packing thicknesses can be achieved. Usually, the different thickness shims are supplied separately, typically in packs of 100 or more, and this does mean that a building contractor needs to ensure that shim packs of all relevant thicknesses are available on-site.

SUMMARY OF THE INVENTION

One aspect of the invention concerns a shim set which obviates the need to purchase separately large numbers of shims of different thickness.

Shims of 10 mm thickness and above require a substantial volume of plastic which is principal factor in the cost of the shim.

A second aspect of the invention concerns a relatively thick shim having a reduced volume of plastic in comparison with conventional shims of the same thickness and also which enables cycle times to be reduced at manufacture to increase manufacturing efficiency.

According to a first aspect of the invention there is provided a shim set comprising at least two shims of different thickness, the shims of the set being integrally formed as a one-piece plastic moulding, the shims of the set being connected in adjacent relationship by a connection which permits an individual shim to be separated from the set but which is flexible to permit a shim while connected to an adjacent shim to be folded over so that the two shims lie in face-to-face relation and thereby form a shim combination of increased thickness.

Advantageously the shim set comprises three shims connected in side-by-side relation to form, in the set, a centre shim and one shim on each side of the centre shim.

In a practical embodiment of the invention, the centre shim has a thickness of substantially 3 mm and the two other shims have thicknesses of substantially 1 mm and 2 mm respectively. This configuration provides selectively:

by breaking of the connections, individual shims of 1, 2, and 3 mm;

by removing one of the side shims and folding the other side shim over onto the centre shim, combined shim thicknesses of 4 mm or 5 mm; and by retaining the connections with both side shims and folding one side shim onto one face of the centre shim and the other onto the opposite face of the centre shim, a combined shim thickness of 6 mm.

According to the second aspect of the invention there is provided a shim moulded from plastic material, the shim having voids extending from at least one edge of the shim into the interior whereby to reduce the volume of plastic material otherwise required to produce the shim.

Advantageously, pairs of axially aligned voids extend into the interior of the shim from opposed edges of the shim, with a solid land being formed between the inner ends of the voids of each pair.

In a preferred embodiment each void is in the form of a generally frustoconical or generally cylindrical passage and the voids are arranged in the shim with their longitudinal axes in parallel relationship.

In a practical embodiment of the invention, the shim has a thickness of substantially 10 mm or more.

According to another aspect of the invention there is provided a method of producing a shim as defined above by injection moulding, wherein the voids are formed by retractable cores within the injection mould, the cores having hollow interiors subject to flow of coolant liquid.

BRIEF DESCRIPTION OF THE DRAWINGS

Embodiments of the invention will now be described by way of example only with reference to the accompanying drawings in which.

DESCRIPTION OF THE PREFERRED EMBODIMENTS

Figure 1:
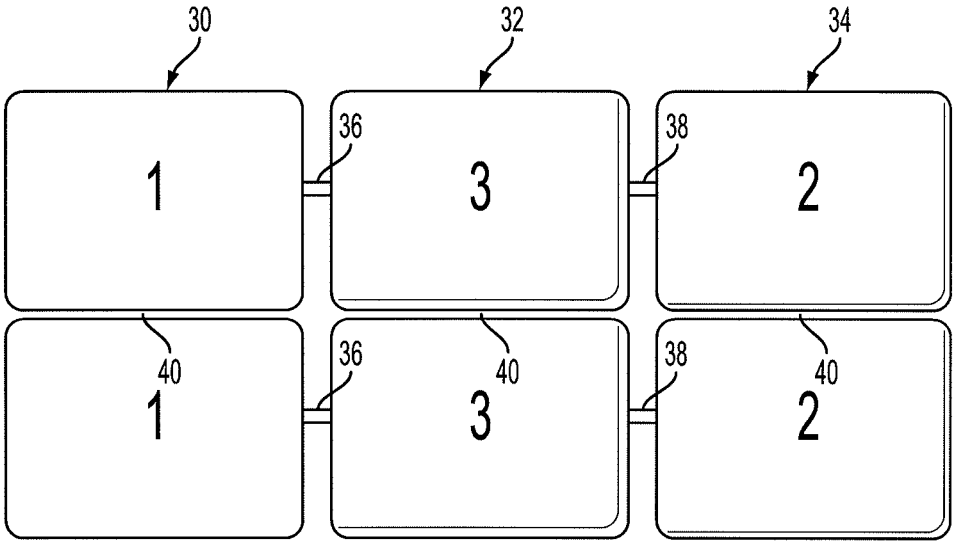
FIG. 1 is a plan view of a shim set in accordance with a first embodiment of the invention.
Figure 2:
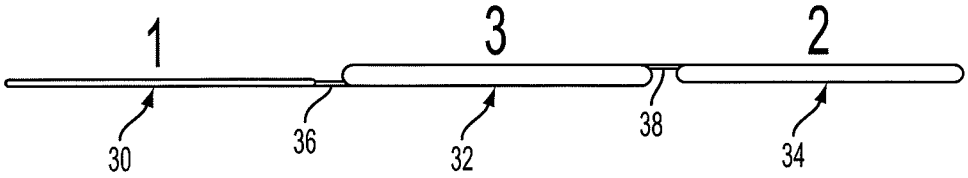
FIG. 2 is an end view of the shim set shown in FIG. 1.

FIGS. 1 and 2 show a shim set in accordance with a preferred embodiment of the invention. The set illustrated consists of three shims 30, 32, 36 connected in side-by-side relation. Each of the shims is of a different thickness, as shown thicknesses of 1, 2, and 3 mm respectively. In the embodiment shown the centre shim 32 is of a thickness of 3 mm, with the 1 mm and 2 mm shims 30, 34 being at opposite sides of the centre shim and being connected thereto by a pair of thin flexible webs 36, 38. The shim set consisting of the three shims and interconnecting webs is integrally formed as a one-piece plastic moulding formed by injection moulding.

Each of the shims provides the sufficient bearing area required to adequately support precast elements. In practice, the minimum width should be 100 mm, but where the panel thickness is less than 100 mm the width of the shim may correspond to the thickness of the panel.

Each shim 30, 32, 34 includes a possible break line 40 midway along its length direction for reasons which will be explained.

Figure 3:
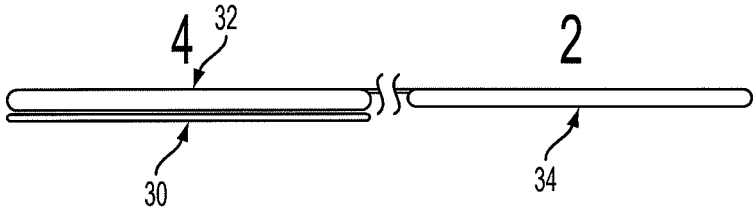
FIGS. 3 to 5 are views similar to FIG. 2 and showing how the shim set can be adapted to provide different thicknesses of combination shim.
Figure 4:
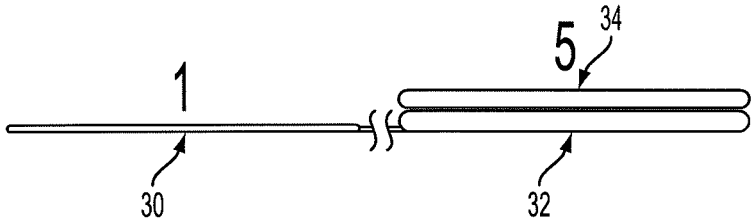
Figure 5:
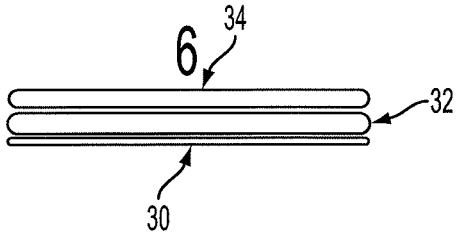

By separating the individual shims in the set by breaking the thin interconnecting webs 36, 38, individual shims of thicknesses 1, 2, or 3 mm will be obtained; breakage of the webs can easily be achieved by twisting the individual shims. However, by removing just one of the two shims at the side of the centre shim, and folding the remaining side shim to lie against an upper or lower face of the centre shim, other thicknesses can be achieved. In particular in the embodiment shown if the 2 mm shim 34 is removed, folding of the remaining 1 mm shim 30 against the face of the 3 mm shim 32 will provide a combined thickness of 4 mm (see FIG. 3) and if the 1 mm shim 30 is removed, folding of the 2 mm shim 34 against the face of the 3 mm shim 32 will provide a combined thickness of 5 mm (see FIG. 4). If neither of the two side shims is removed, folding of one against the upper face and the other against the lower face of the 3 mm shim a combined shim thickness of 6 mm will be attained (see FIG. 5).

It will be noted from FIG. 2, that the thin webs 36 joining the 1 mm shim 30 to the 3 mm shim 32 are substantially coplanar with the lower face of both those shims, whereas the thin webs 38 joining the 2 mm shim 34 to the 3 mm shim 32 are substantially coplanar with the upper faces of those shims. This configuration facilitates folding of the 1 mm shim 30 against the underface of the central 3 mm shim 32 and folding of the 2 mm shim 34 against the upper face of the central 3 mm shim 32. While this is preferred as it facilitates the folding action, nevertheless the required result could still be achieved with the thin connecting webs located centrally between the upper and lower faces of the central 3 mm shim, but would likely require the length of the connecting webs to be increased to accommodate the necessary folding action.

With the shim set manufactured and supplied as several connected shims of different sizes which can be separated or combined as required, a building contractor will not need to pre-order and have available individual shims covering the range of different sizes as to be necessary. It will of course be appreciated that if or more of the individual shims is separated from the set and is not required for use at that particular time it can be retained for future use.

In addition to its usage as a packing shim, the shims 30, 32, 34 can also be used as spacers for example between adjacent vertical edges of concrete panels. For this application the full bearing surface area of the shim is not required and the shim can be split into two parts by breaking along the central break line 40.

Although the embodiment described has shims of 1, 2, and 3 mm thickness and thereby provides singly or in combination shim thickness commonly required in practice, it is to be understood that other shim thickness can alternatively be adopted.

Figure 6:
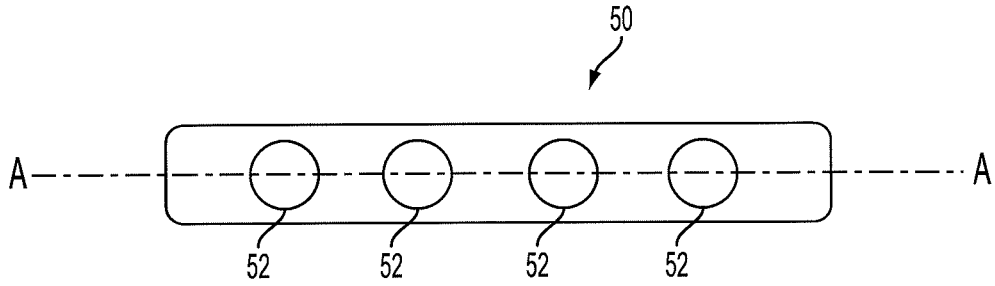
FIG. 6 is an end view of a shim in accordance with a second embodiment of the invention.
Figure 7:
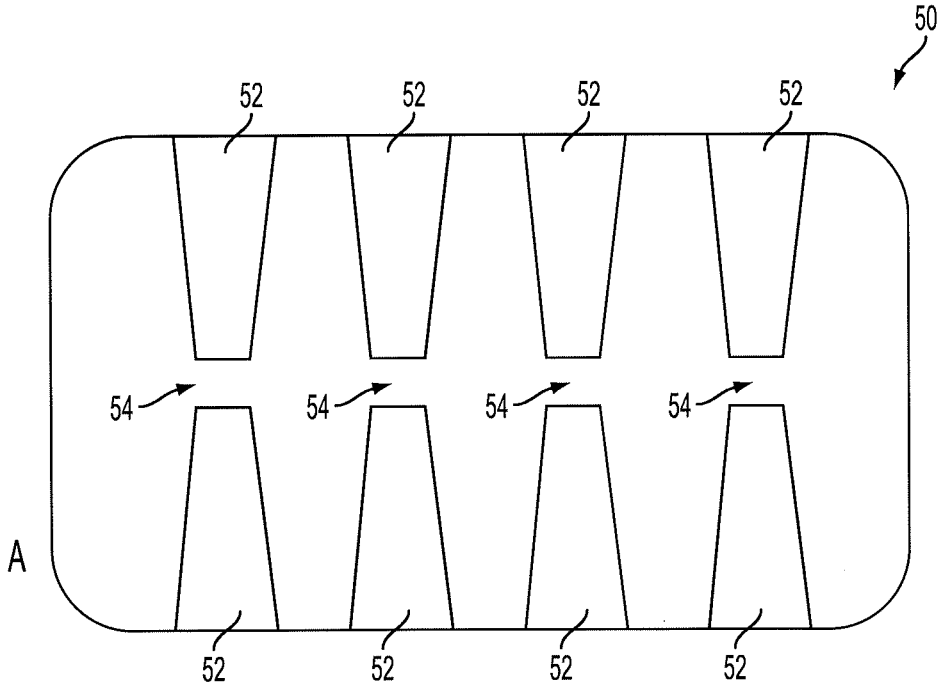
FIG. 7 is a section on line A-A of FIG. 6.

FIGS. 6 and 7 relate to an injection moulded shim construction for a thicker shim, typically a 10, 15, or 20 mm shim. During moulding, the shim 50 is formed with a plurality of voids 52 which reduce the amount of plastic material required. The voids 52 are in the form of passages extending from opposed edges of the shim 50 with their longitudinal axes in parallel relation. The voids 52 are formed during moulding using retractable cores which are hollow and subject to a flow of cooling water. The cooled cores, which extend a substantial depth into the interior of the moulding, ensure rapid cooling of the moulded product and thereby significantly reduce the moulding cycle time.

In the embodiment shown there are four pairs of aligned voids 52, with the two voids of each pair being separated by a central land 54 which assists in maintaining the compressive strength of the shim when under loading.

Although as shown the voids 52 are of a frustoconical shape, alternatively they may be of a cylindrical shape albeit possibly with a slight taper to facilitate retraction of the cores after moulding.

In a further alternative, each pair of voids may be replaced by a single void extending the entire dimension of the shim between the opposed edges. In that case, with the absence of the central lands 54 which assist in maintaining the compressive strength, the diameter of the voids will need to be appropriately determined in relation to the type of plastic material used to ensure that the shim will have the requisite load bearing strength.

The embodiments have been described by way of example only and modifications are possible within the scope of the invention.

The claims defining the invention are as follows:

1. A shim set comprising:

at least two shims of different thickness, the shims of the set being integrally formed as a one-piece plastic moulding, the shims of the set being connected in adjacent relationship by a connection which permits an individual shim to be separated from the set but which is flexible to permit a shim while connected to an adjacent shim to be folded over so that the two shims lie in face-to-face relation and thereby form a shim combination of increased thickness.

2. A shim set according to claim 1, wherein the set comprises three shims connected in side-by-side relation to form, in the set, a center shim and one shim on each side of the center shim, each shim being of a thickness different to that of the other shims.

3. A shim set according to claim 2, wherein the center shim has the greatest thickness.

4. A shim set according to claim 3, wherein the flexible connection between the center shim and a first of the other shims is substantially co-planar with one of the two faces of the center shim, and the flexible connection between the center shim and the second of the other shims is substantially co-planar with the other of the two faces of the center shim.

5. A shim set according to claim 3, wherein each shim has a central break line to enable the shim to be split into two parts for use as spacers.

6. A shim set according to claim 3, wherein the center shim has a thickness of substantially 3 mm and the two other shims have thicknesses of substantially 1 mm and 2 mm respectively, the configuration providing selectively:

by breaking of the connections, individual shims of 1, 2, and 3 mm;

by removing one of the side shims and folding the other side shim over onto the center shim, combined shim thicknesses of 4 mm or 5 mm; and by retaining the connections with both side shims and folding one side shim onto one face of the center shim and the other onto the opposite face of the center shim, a combined shim thickness of 6 mm.

* * * * *